US009366211B2

(12) United States Patent
Torizuka et al.

(10) Patent No.: US 9,366,211 B2
(45) Date of Patent: Jun. 14, 2016

(54) ORIFICE PLATE AND MANUFACTURING METHOD OF THE ORIFICE PLATE

(75) Inventors: Shiro Torizuka, Ibaraki (JP); Eijiro Muramatsu, Ibaraki (JP); Takafumi Komatsu, Nagano (JP); Hitoshi Kobayashi, Nagano (JP); Shin-ichi Nagayama, Saitama (JP); Mitsuyuki Tanaka, Saitama (JP)

(73) Assignees: NATIONAL INSTITUTE FOR MATERIALS SCIENCE, Tsukuba-shi (JP); KOMATSU SEIKI KOSAKUSHO CO., LTD., Suwa-shi (JP); TOKUSHU KINZOKU EXCEL CO., LTD., Tokyo (JP)

( * ) Notice: Subject to any disclaimer, the term of this patent is extended or adjusted under 35 U.S.C. 154(b) by 688 days.

(21) Appl. No.: 13/320,397

(22) PCT Filed: May 14, 2010

(86) PCT No.: PCT/JP2010/058235

§ 371 (c)(1),
(2), (4) Date: Jan. 24, 2012

(87) PCT Pub. No.: WO2010/131755

PCT Pub. Date: Nov. 18, 2010

(65) Prior Publication Data

US 2012/0125067 A1 May 24, 2012

(30) Foreign Application Priority Data

May 14, 2009 (JP) ..... 2009-117888

(51) Int. Cl.
*F02M 61/18* (2006.01)
*B21D 28/16* (2006.01)
(Continued)

(52) U.S. Cl.
CPC ..... *F02M 61/1853* (2013.01); *B21D 28/16* (2013.01); *B21D 35/005* (2013.01);
(Continued)

(58) Field of Classification Search
CPC ..... B21B 3/02; B21D 28/24; F02M 61/1853
USPC ..... 72/203, 204, 206, 214, 293, 294, 326, 72/327, 331–333, 337, 355.4, 372, 379.2; 29/557
See application file for complete search history.

(56) References Cited

U.S. PATENT DOCUMENTS 3,978,705 A * 9/1976 Pearce et al. ..... 72/325
5,376,195 A * 12/1994 Shindo et al. ..... 148/541
(Continued)

FOREIGN PATENT DOCUMENTS

EP 1234894 A1 * 8/2002
JP 2000-051964 A 2/2000
(Continued)

OTHER PUBLICATIONS

S. Torizuka, "Shearing characteristics of ultrafine grained steel", CAMP-ISIJ, Sep. 1, 2008, vol. 21, No. 2, p. 1648.
(Continued)

*Primary Examiner* — Alexander P Taousakis
*Assistant Examiner* — Pradeep C Battula
(74) *Attorney, Agent, or Firm* — Westerman, Hattori, Daniels & Adrian, LLP

(57) ABSTRACT

An orifice plate for liquid injection made of plate-shaped stainless steel, wherein an orifice is formed by shearing, is characterized in that the average crystal grain size of the stainless steel is 3 μm or less. The thickness of the plate-shaped stainless steel is 1.2 mm or less, and preferably 0.1 mm or less. The aspect ratio of the orifices is 0.8 or lower. The orifices are formed orthogonal to the plate surface, or slanted by 50° or at smaller angles. The plate-shaped stainless steel has a composition containing C, Mn, and Si.

11 Claims, 12 Drawing Sheets

(51) Int. Cl.

| | |
|---|---|
| ***B21D 35/00*** | (2006.01) |
| ***C21D 6/00*** | (2006.01) |
| ***C21D 7/02*** | (2006.01) |
| *F02B 23/10* | (2006.01) |

(52) U.S. Cl.

CPC ..... *C21D 6/004* (2013.01); *C21D 7/02* (2013.01); *F02M 61/1813* (2013.01); *C21D 2201/03* (2013.01); *C21D 2211/005* (2013.01); *C21D 2261/00* (2013.01); *F02B 2023/103* (2013.01); *F02M 2200/9053* (2013.01)

(56) References Cited

U.S. PATENT DOCUMENTS

| | | | | |
|---|---|---|---|---|
| 6,221,178 | B1 * | 4/2001 | Torizuka et al. | 148/320 |
| 6,357,677 | B1 * | 3/2002 | Ren et al. | 239/585.4 |
| 7,444,991 | B2 * | 11/2008 | Joseph | 29/557 |
| 8,268,101 | B2 * | 9/2012 | Conrad | C21D 8/0205 148/282 |
| 2002/0038825 | A1 | 4/2002 | Takeshita et al. | |
| 2009/0301161 | A1 * | 12/2009 | Fujimura et al. | 72/328 |

FOREIGN PATENT DOCUMENTS

| | | | |
|---|---|---|---|
| JP | 2002-102977 | A | 4/2002 |
| JP | 2002-146584 | A | 5/2002 |
| JP | 2004-322066 | A | 11/2004 |
| JP | 2006-334599 | A | 12/2006 |
| JP | 2007-061992 | A | 3/2007 |

OTHER PUBLICATIONS

H. Kobayashi, "Characteristics of Sheared surfaces of ultra fine grain steel", CAMP-ISIJ, Sep. 1, 2008, vol. 21. No. 2, p. 1649.

International Search Report of PCT/JP2010/058235, mailing date Aug. 17, 2010.

* cited by examiner

Dp : Punch diameter
Dd : Die diameter
θ : Working angle
t : Plate thickness (Unit: mm)

| Gage length L | Length of parallel portion P | Width of parallel portion W | Shoulder radius R | Grip width B |
|---|---|---|---|---|
| 10 | 10 | 5 | 6 | 17 |

ORIFICE PLATE AND MANUFACTURING METHOD OF THE ORIFICE PLATE

TECHNICAL FIELD

The present invention relates to an orifice plate obtained by press working of plate-shaped stainless steel and a manufacturing method of the orifice plate.

BACKGROUND ART

As a technique of manufacturing an orifice plate, press shearing, wherein a material to be processed is die-cut in a given dimension, is known. In general press shearing, a cut end surface includes shear drop 3, sheared surface 4, fracture surface 5, and burr 6. Conventional press shearing has problems such as "large shear drop and large burr," "large fracture surface and small sheared surface," and "sheared surface and fracture surfaces not on a same plane." If orifice plates for injecting liquids, etc. are manufactured by the known processing method described above, these problems may cause flow rate fluctuations in the orifice plates.

As a shearing method to ensure precision punching allowing little or no shear drop 3 or fracture surface 5 on the cut end surface of a material having undergone press shearing, shaving and fine blanking methods are generally known.

In a shaving method, as disclosed in Patent Literature 1, for example, punching is performed in advance in a dimension and shape including a shaving allowance (rough punching), and then the shaving allowance only is die-cut accurately in the shaving process. In the shaving process, by performing shaving once to several times depending on the degree of difficulty and desired precision of the processing, a cut end surface with little shear drop 3 and fracture surface 5, and a large and smooth sheared surface 4 is obtained. However, since the number of times of shaving processes must be increased and more precise dies are needed, production cost increases. Furthermore, the number of working processes increases, and the die accuracy must be improved.

In a fine blanking method, as disclosed in Patent Literature 2, for example, by creating a protrusion in a work-supporting section and minimizing the clearance between a punch and a die, high compression stress is generated within a material, which increases the ductility of the material, thus delaying generation of cracks. The fine blanking method can produce a clear cut end surface having small shear drop 3 and small fracture surface 5, and a large, and smooth sheared surface 4. However, due to high accuracy required for the punch and the die, the cost for die and punch increases. In addition, manufacturing a die and a punch for fine parts is difficult structurally, and this method is inadaptable to products to be manufactured by piercing.

CITATION LIST

Patent Literature

Patent Literature 1: JP2000-51964A
Patent Literature 2: JP2007-61992A

SUMMARY OF THE INVENTION

Technical Problem

In a shearing process, a punch and a die must be fitted, allowing a clearance of several percent of the plate thickness along the cutting shape. Consequently, the thinner the thickness of a material plate is, the more difficult manufacturing of a die becomes. In addition to the problem of increased cost for manufacturing a die and punch, since the punch and the die contact each other due to vibration during processing under reduced clearance conditions, the life of the die is shorter, compared to a case where thicker materials are sheared. A cut end surface formed by this pressing process consists of shear drop 3, sheared surface 4, fracture surface 5, and burr 6 viewed from the above, and the sheared surface 4 becomes smooth by transcription of the surface of the punch. The fracture surface 5, however, becomes rough due to tensile force of the material.

It is therefore an object of the present invention to minimize and stabilize flow rate fluctuations of a fluid to be injected via an orifice plate equipped to a fluidic injection device and other devices.

Solution to Problem

To solve the above problems, it is necessary to maintain the height h and width w of the shear drop 3 formed on the cut end surface uniform along the cutting contour as shown in FIG. 13.

The present invention intends to solve the above problems by providing an orifice plate made of stainless steel of a fine grain structure having the average crystal grain size of 3 μm or less, and a cut end surface punched by shearing, and a method of manufacturing the orifice plate.

If this orifice plate is manufactured by continuous precision multi-shot punching, variations in the shape of the inlet of orifices are minimal among products. In this case, it is desirable that the contour lines representing the surface constituting the inlet viewed from the inlet side of the orifice be maintained uniform among products.

To achieve the above objective, the orifice plate of the present invention is characterized in that the orifice plate is made of ultrafine grain steel. The cut end surface of this orifice has undergone shearing process allowing minimal shear drop.

The inventor et al. have worked on this study, focusing on the shearing characteristics of ultrafine grain steel.

Ultrafine grain steel has well-balanced strength and ductility, and also has high cold headability. In addition, the characteristics of ultrafine grain steel, namely small work hardening and high ductility, have a significant effect on shearing characteristics.

As ultrafine grain steel, ferrite single-phase ultrafine grain steel having a composition of 0.002C-0.3Mn-0.2Si and 0.01C-0.3Mn-0.2Si (average grain size: 0.7 μm) was used to create bar stock by warm caliber rolling. In addition, a part of the above ferrite single-phase ultrafine grain steel having the composition of 0.01C-0-0.3Mn-0.2Si was subjected to heat treatment at 650° C. to create bar stock of ferrite single-phase course grain steel having a composition of 0.01C-0.3Mn-0.2Si (average grain size: 13 μm).

For comparison, ferrite+pearlite steel having a composition of 0.3C-1.5Mn-0.3Si (average grain size: 20 μm) was created by hot rolling.

FIG. 1 presents the stress-strain curve of each bar. Using these materials, samples in a thin plate shape having a width of 18 mm and a thickness of 1 mm were created by electric discharge machining and surface grinding, and punching was performed using a die shown in FIG. 2. The diameter of a punch 9 was 3.00 mm, the internal diameter of a dice (die) 8 was 3.04 mm, 3.12 mm, and 3.20 mm, and the clearance was 2.0%, 6.0%, and 10.0%.

The cut end surface of the opening formed in the thin plate samples as described above was observed. The lengths of the shear drop, sheared surface, and the fracture surface were measured, the measured values were converted into shear drop ratio, sheared surface ratio, and fracture surface ratio, namely the ratio of each length to the thickness. FIG. 3 shows the result of the effect of the clearance.

As clearly shown in FIG. 3, the smaller the clearance, the lower the shear drop ratio, the higher the sheared surface ratio and the lower the fracture surface ratio. This behavior is found regardless of whether the composition is ferrite single-phase structure or ferrite+pearlite structure, or whether the crystal grains are fine or course. Even if the clearance decreases to 10% to 6%, the difference in both clearances remains small. However, if the clearance further decreases to 2%, the behavior of decrease in shear drop ratio, increase in sheared surface ratio, and decrease in fracture surface ratio becomes apparent.

Comparison between 0.01C fine grain material and 0.3C ferrite+pearlite material, which have similar tensile strength (TS), shown in FIG. 3 reveals that the shear drop ratio of the fine grain material remained low regardless of the size of clearance. Comparison between each material in FIG. 3 reveals that the shear drop ratios of 0.01C and 0.002C fine grain materials were as small as 1.6% and 2.3% respectively when the clearance was 2%. Meanwhile, the shear drop ratio of 0.010 coarse material was as large as 5.6%, and that of 0.3C ferrite+pearlite material was also as large as 4.5%. As shown above, the shear drop ratio of a fine grain material can be decreased, and the dependence of the size of the shear drop on clearance can also be decreased.

When manufacturing an orifice plate made of a fine grain material by shearing, namely by performing continuous precision multi-shooting slot shear punching, even if the clearance fluctuates slightly among multiple shots, the absolute value of fluctuation of the shear drop resulting from the fluctuation in clearance can be decreased if the orifice plate is.

Consequently, if a fine grain material is used, the fluctuation range of cutting shape of openings decreases. The fluctuation in the flow rate of the fluid injected from the orifice plate can thus be minimized and stabilized.

Advantageous Effect of the Invention

According to the present invention, the fluctuation in the flow rate of the fluid to be injected from the orifice plate can be decreased.

BRIEF DESCRIPTION OF THE DRAWINGS

FIG. 8 (*b*) provides the image of the same orifice as (*a*) measured by the focus shift method using a non-contact three-dimensional measuring instrument.

REFERENCE SYMBOL LIST

Figure 1:
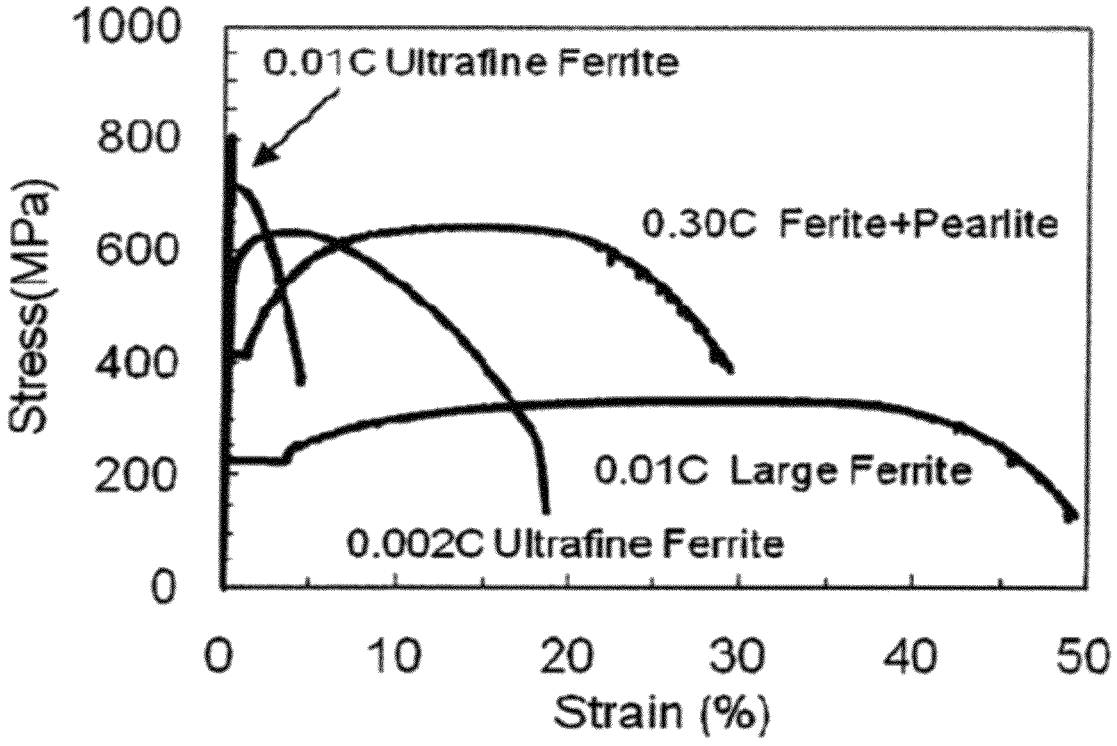
FIG. 1 is a chart representing stress-strain curves of ultrafine grain and coarse grain materials.
Figure 2:
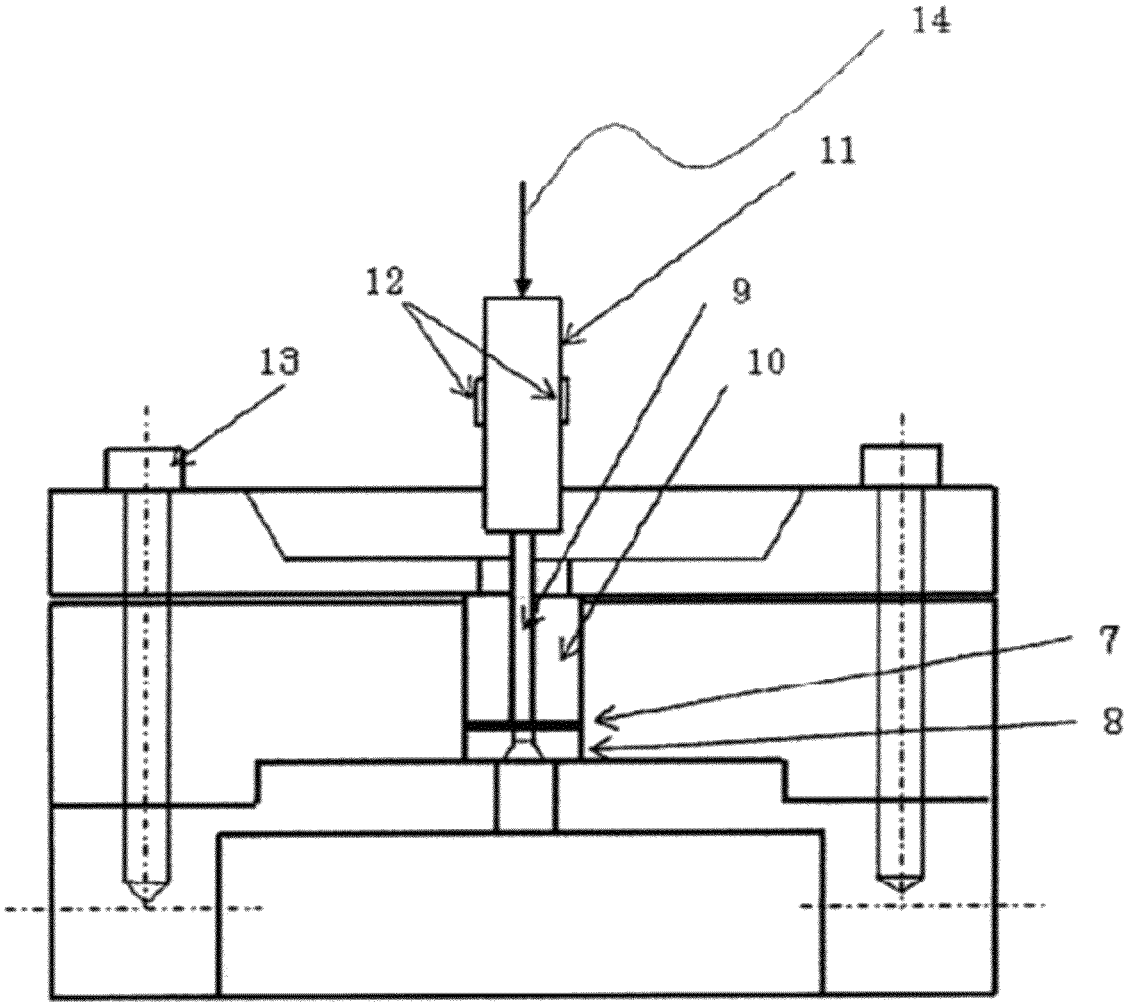
FIG. 2 is a diagram illustrating a die and punch used for a shearing test.
Figure 3:
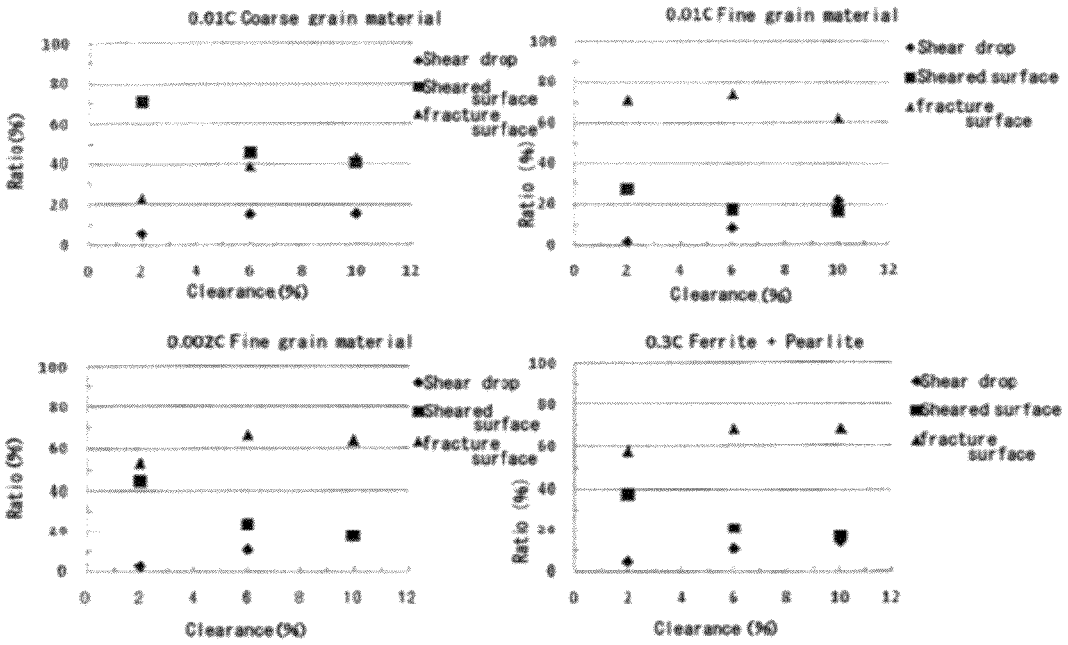
FIG. 3 summarizes the effect of composition and clearance on shear drop ratio, sheared surface ratio, and fracture surface ratio.

1 Center line
2 Orifice
2*a* Orifice at a given position
3 Shear drop
4 Sheared surface
5 Fracture surface
6 Burr
7 Material to be processed
8 Die
9 Punch
10 Upper die (punch holder)
11 Press
12 Strain gauge
13 Bolt fastening the material to be processed
14 Load
t Plate thickness
Dp Punch diameter
Dd Die diameter
θ Working angle

DESCRIPTION OF EMBODIMENTS

The orifice plate for injecting liquids in accordance with the embodiment of the present invention is made of stainless steel of a fine grain structure having crystal grain size of 3 μm or less, namely ultrafine grain steel, and has openings obtained by subjecting a coiled stainless steel strip to shear punching.

A material to be processed to manufacture a metallic orifice plate for injecting liquids in accordance with the present invention can be obtained by using an austenite stainless steel strip of an appropriate thickness selected in consideration of the thickness of the orifice plate. The strip is subjected to cold rolling and reverse transformation heat treatment, and more preferably by conducting these treatments repeatedly. In the reverse transformation heat treatment, the amount of stress-induced martensite is decreased to a given amount or lower. By adjusting the reverse transformation heat treatment conditions, the average austenitic crystal grain size is reduced to 3 μm or lower, more preferably to 0.5 μm or lower.

Figure 12:
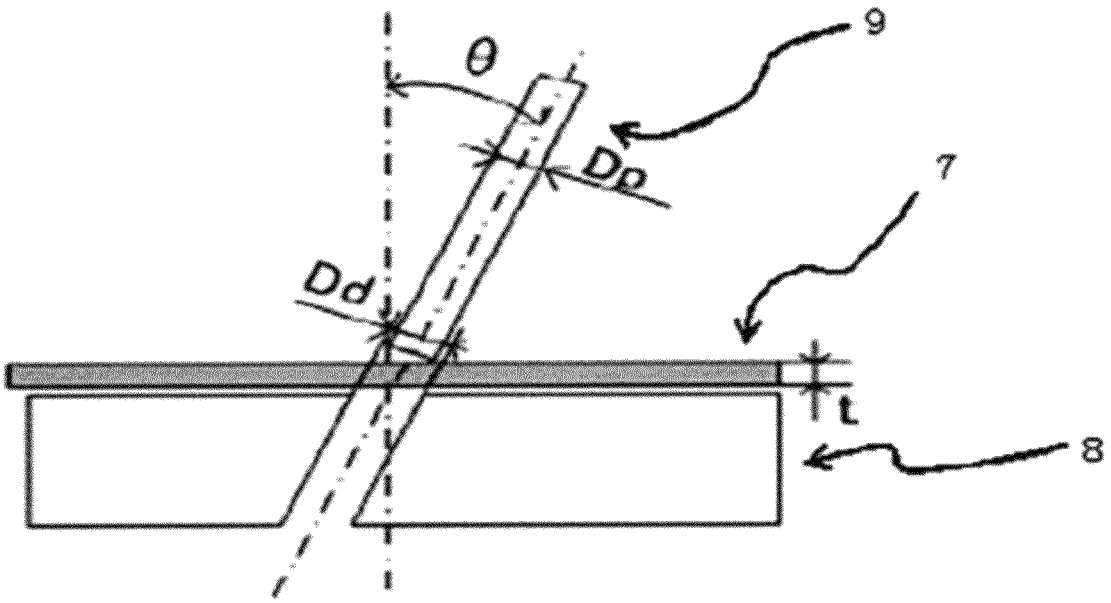
FIG. 12 is a diagram illustrating the press punching process generally performed using a punch and a die.
Figure 13:
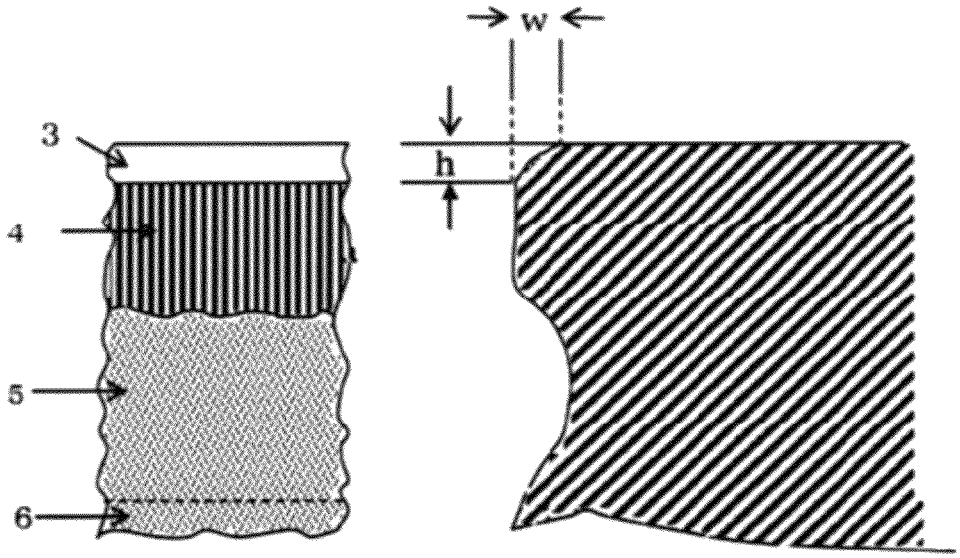
FIG. 13 is a diagram illustrating the characteristic state of a surface obtained by shear punching of a thin metal plate.
Figure 14:
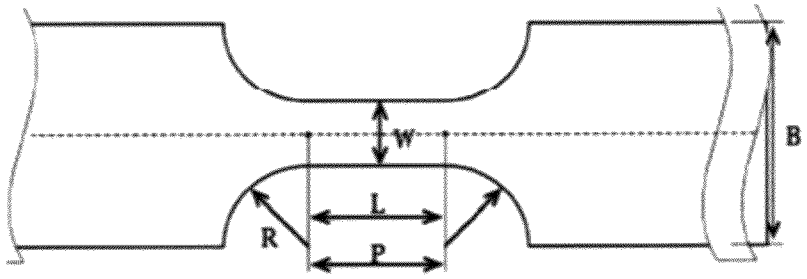
FIG. 14 is a chart illustrating the shape and dimension of a tensile test piece of the test material in examples 1 to 3 and comparative example 1.

To manufacture a metallic orifice plate for injecting liquids using a material to be processed, desired openings are formed by shearing such as press shear punching using a punch 9 and die 8 shown in FIG. 12. This shearing achieves simple and low-cost manufacture without using special equipment.

The working angle θ in FIG. 12 should fall within a range approximately from 0° to 50°. There is no limit to the aspect ratio of the orifice, and even the aspect ratio of 0.8 or lower is applicable. This aspect ratio (plate thickness/opening diameter) can be approximated by plate thickness/punch diameter. In addition, the present invention also has an effect on an orifice plate having plate thickness of 1.2 mm or lower, and even on an ultrathin orifice plate having the thickness of 0.1 mm or lower.

EXAMPLE

The effectiveness of the present invention will hereinafter be described in detail by referring to examples. The present invention are not limited to the examples shown below. It is of course possible to implement the present invention by making appropriate changes to the embodiment described above without departing from the scope of the invention. All of these variations are contained within the technical scope of the present invention. For example, the orifice plates in accordance with the embodiment of the present invention are not limited to those for injecting liquids, but applicable to other fluids, gases for example.

Examples 1 to 3 and Comparative Example 1

The materials for Examples 1 to 3 were cold rolled stainless strips having the chemical compositions shown in Table 1 (a). These strips made of JIS G4305 SUS304 No. 2B-finish cold rolled stainless steel had thickness of 3 mm. The materials were subjected repeatedly to cold rolling of 50% to 60% rolling reduction and to reverse transformation heat treatment so that the amount of stress-induced martensite generated by the cold rolling decreases to 5% or lower when measured using a ferrite content measuring instrument. The strips were processed into the thickness of 0.1 mm. By adjusting the final reverse transformation heat treatment conditions (temperature and time) as required, test materials having different average austenite crystal grain sizes were obtained and used for examples 1 to 3.

The material for comparative example 1 to be described in this section is a JIS G4313 SUS304 ½-finish stainless steel strip for springs, namely a coiled cold rolled steel strip of chemical compositions shown in Table 1 (b), having thickness of 0.1 mm and width of 20 mm.

TABLE 1

| | C | Si | Mn | P | S | Ni | Cr |
|---|---|---|---|---|---|---|---|
| (a) | 0.06 | 0.40 | 1.09 | 0.030 | 0.004 | 8.03 | 18.02 |
| (b) | 0.05 | 0.47 | 0.98 | 0.028 | 0.007 | 8.21 | 18.20 |

Each test piece of coiled thin steel strips having plate thickness t of 0.1 mm and length of approximately 500 m prepared as described above for examples 1 to 3 and comparative example 1 was subjected to a tensile test, hardness test, structural observation by EBSP, and precision press punching test.

As described below, all of the examples 1 to 3 fall within the range of orifice plate for injecting liquids in accordance with the present invention. Details will be described below.

(Material Test Method)

In the tensile test, test pieces obtained by cutting with the tensile direction coincided with the direction of rolling (L direction) and with the direction orthogonal to the direction of rolling (C direction) were tested at the tension speed maintained at 0.5 mm/min. to measure their tensile strength and total elongation.

In the hardness test, Vickers hardness of the surface of the steel plates was measured.

In the structural observation by EBSP, average austenitic crystal grain size was measured on the cross-sectional plane parallel to the L direction and at the center in the direction of plate thickness. The areas of crystal grain on the cross section were converted into circles having equivalent areas, and their diameters were measured as crystal grain size.

(Material Test Result)

Figure 4:
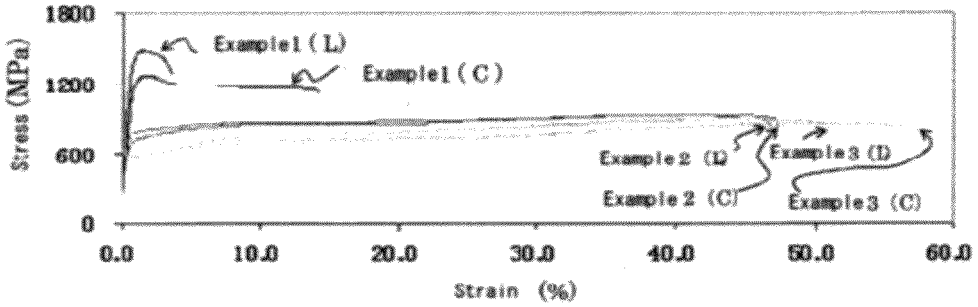
FIG. 4 is a chart representing the stress-strain curves of the test materials in examples 1 to 3.
Figure 5:
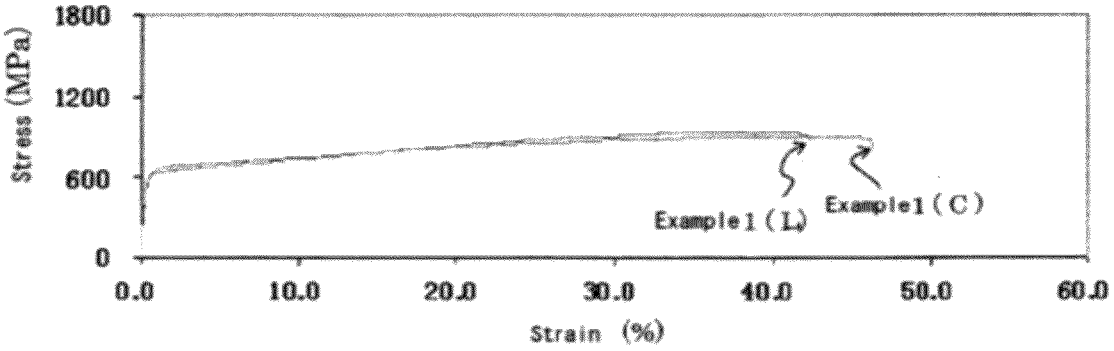
FIG. 5 is a chart representing the stress-strain curves of the test materials in comparative example 1.
Figure 6:
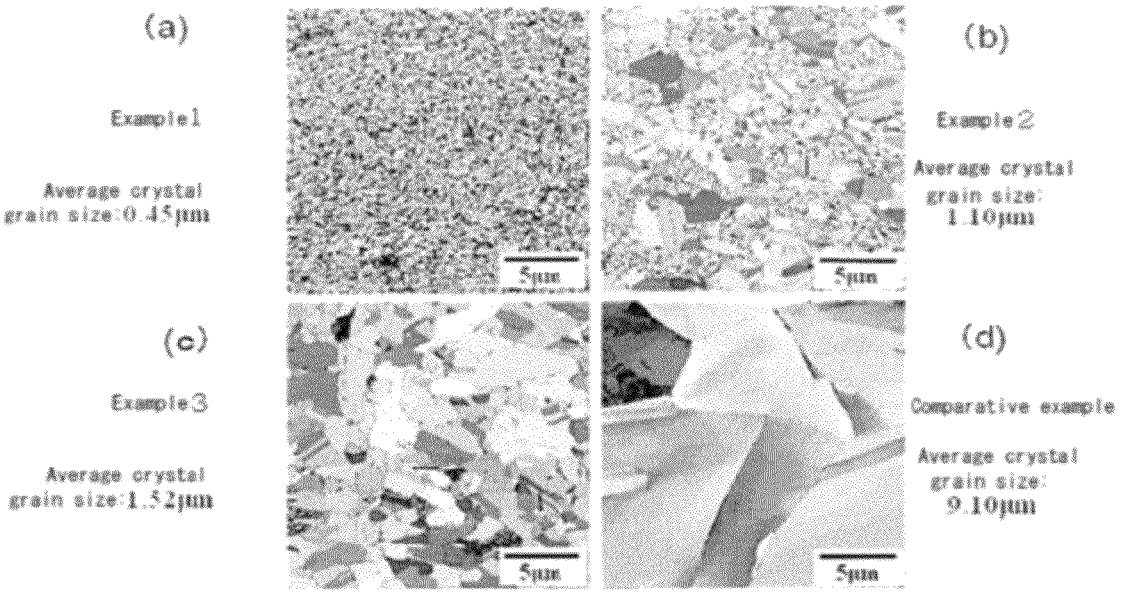
FIGS. 6(*a*)-(*d*) present electron backscatter diffraction pattern (EBSP) analysis images of the crystalline structure in examples 1 to 3 and comparative example 1.

FIG. 4 presents stress-strain curves of the test materials in examples 1 to 3, FIG. 5 presents stress-strain curves of the test materials of comparative example 1, and Table 2 lists the tensile strength and total elongation. Table 2 also presents the average austenitic crystal grain size of each test material. FIG. 6 presents EBSP analysis images of crystalline structure at the position where the average austenitic crystal grain size was measured.

TABLE 2

| | Tensile strength (MPa) | | Total elongation (%) | | Hardness (HV) | Average austenitic crystal grain size (μm) |
|---|---|---|---|---|---|---|
| | L direction | C direction | L direction | C direction | | |
| Ex. 1 | 1266 | 1483 | 16.1 | 3.6 | 400 | 0.45 |
| Ex. 2 | 909 | 915 | 46.8 | 47.5 | 300 | 1.10 |
| Ex. 3 | 870 | 858 | 51.1 | 57.5 | 260 | 1.52 |
| Com. Ex. 1 | 919 | 880 | 42.5 | 46.4 | 260 | 9.10 |

In examples 1 to 3, the average austenitic crystal grain size decreased to 1.52 μm or lower by adjusting reverse transformation heat treatment conditions. In example 1, in particular, 45 μm ultrafine grained austenitic structure was obtained. The residual martensite of each of the examples was measured to be 5% or lower using a ferrite content measuring instrument.

In example 1, by making the average crystal grain size to be as ultrafine as 0.45 μm, high tensile strength exceeding 1.2 GPa was obtained, and Vickers hardness (HV) also increased to 400 accordingly. As seen in FIG. 4, in example 1 where the average crystal grain size was made to be as ultrafine as 0.45 μm, work hardening was small, uniform elongation was not observed after the yielding and a constriction was exhibited due to plastic instability.

Meanwhile, in comparative example 1, since cold rolling and reverse transformation heat treatment were not conducted, the average austenitic crystal grain size was as coarse as 9.10 μm, which was much larger than the sizes in examples 1 to 3. Since cold rolling of ½ H specifications (½ hard) was conducted, the tensile strength (880 to 910 MPa) remained at the same level as example 3 (858 to 870 MPa).

The total elongation is an appropriate level, 42.5% to 46.4%, and when strength-total elongation balance was compared with that of ultrafine grained structural steel in examples 2 and 3, no significant difference was found.

However, as described later, in examples 1, 2, and 3, the stability of the shape of "edge portion," namely the outline of the contour of inlet, was found to be better than the stability of comparative example 1 as a result of the precision press punching test.

(Precision Press Punching Test Method)

The test materials of examples 1 to 3 and the test material of comparative example 1 described previously were subjected to press punching test as follows:

A test material having plate thickness t of 0.1 mm was subjected to oblique press punching with punching diameter Dp of 0.137 mm, die diameter Dd of 0.147 mm, clearance of 0.005 mm, center clearance of 5%, and working angle of 33.5°, using plant press working oil as working oil. The orifice was made to be in straight shape.

Figure 7:
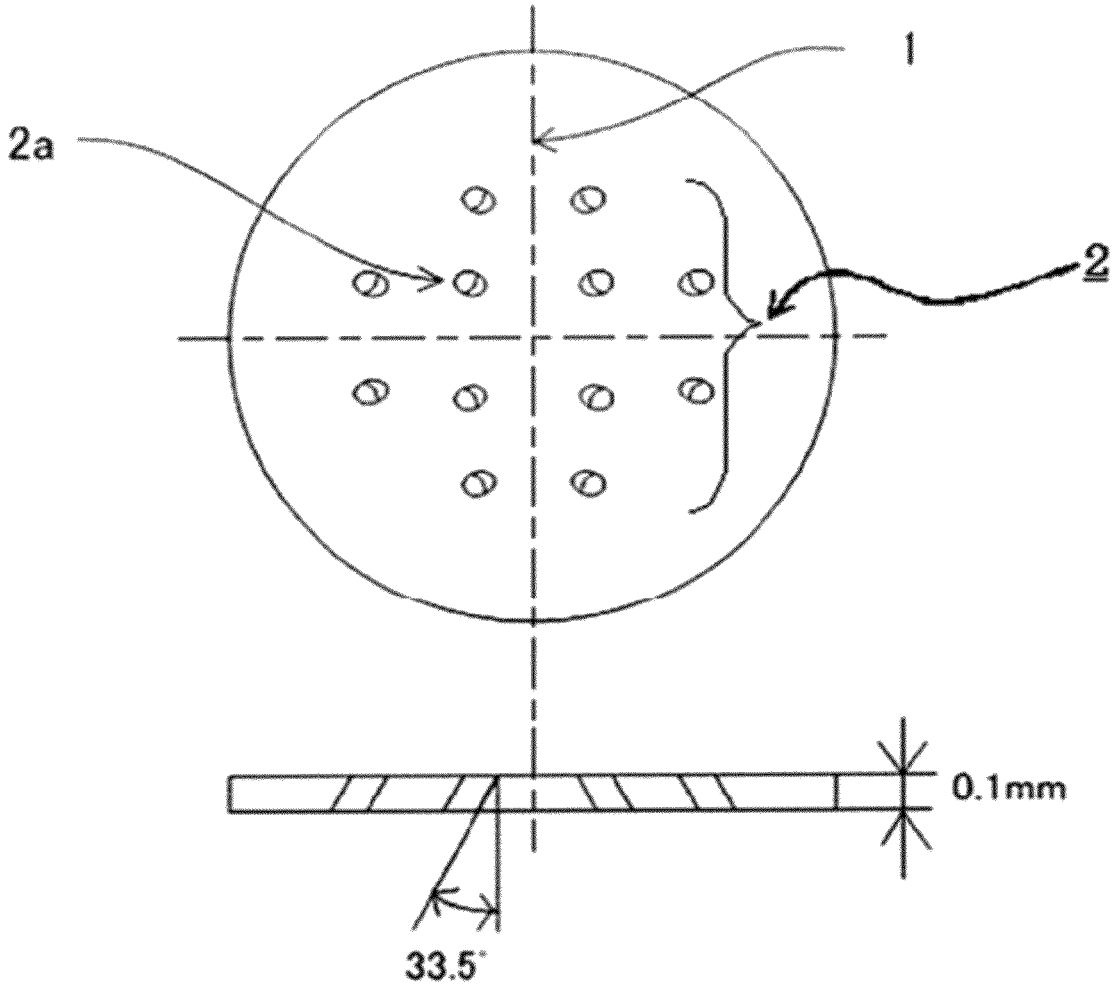
FIG. 7 presents a plan view and a side view illustrating the layout and the working angle of press punching in examples 1 to 3 and comparative example 1.

First, as comparative example 1, 10,000-shot continuous precision slot punching was performed using the test material for comparative example 1. The punch only was then replaced, and as example 1, 10,000-shot continuous precision slot punching was conducted using the test material for example 1. With examples 2 and 3 also, the punch only was replaced as in the case of example 1, and 10,000-shot continuous precision slot punching was conducted. As shown in FIG. 7, on a plate having thickness t of 0.1 mm, total of 12 openings were punched symmetrically with respect to the center line 1, being slanted outward at the working angle of 33.5°.

(Method of Measuring the Shape of the Slots and the State of Punched Surface)

The shape of the inlet of the orifices after the punching was observed under an SEM. Contour line images of the shape of the inlet were also obtained by the focus shift method using a non-contact 3D measuring instrument (IF-2000, Alicona).

1. Results Concerning the Stability of Cutting Contour and Shear Drop (1-1) Result of the 10,000th-Shot Punching The shape of the inlet of the orifice obtained after the 10,000th-shot punching is described below.

Figure 8:
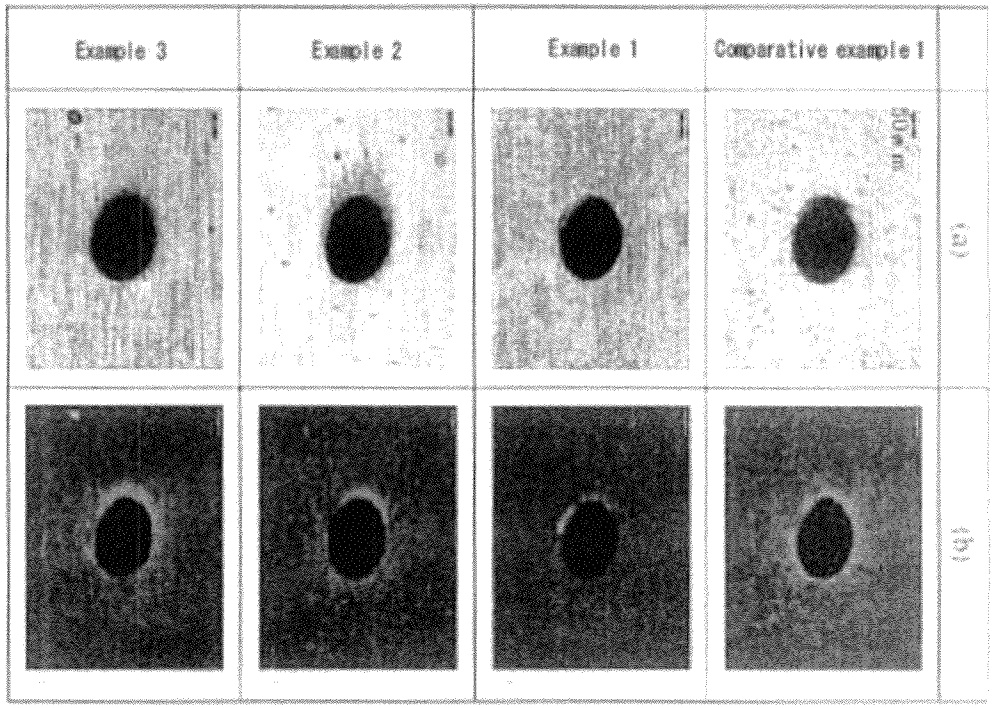
FIG. 8 (*a*) provides the images of the inlets of the orifices after the 10,000th shot of continuous precision slot punching in examples 1 to 3 and comparative example 1.

As the contour of the inlet of the orifice, nonuniform portion was found on the periphery of the openings in comparative example 1, whereas nonuniformity was not found with examples 1 to 3. In other words, the contour of the inlet in examples 1 to 3 exhibited smoother curves. FIG. 8(*a*) presents SEM images of the contour of orifice inlet taken at the position shown by symbol 2*a* in FIG. 7 after 10,000-shot continuous precision slot punching was performed for examples 1 to 3 and comparative example 1. FIG. 8(*b*) presents images of the same orifice shown as the SEM images of examples 1 to 3 and comparative example 1, obtained by the focus shift method using a non-contact 3D measuring instrument.

These images exhibit that more uniformity in contour lines is maintained in examples 1 to 3 than comparative example 1. In addition, the smaller the average crystal grain size, the higher the uniformity of the contour lines, and the average crystal grain size of example 1 was 0.45 μm, which is quite desirable. In other words, the smaller the average crystal grain size of the plate material, the smoother the contour of the inlet of the orifice edge, and better orifices can thus be obtained.

(1-2) Result of Comparison in Stability Among Continuous 120-Shot Punching Processes Closest to the 10,000th Shot In each of examples 1 to 3 and comparative example 1, the contour shape of the inlet of the orifice located at the position shown by symbol 2*a* in FIG. 7, of the 120 orifices obtained by continuous 120-shot punching from the 9,881th to the 10,000th shots, was observed under an SEM.

The continuously processed 120 orifices were examined for a sporadic change in the contour shape of the orifice inlet, and the number of orifices whose contour shape had changed was counted.

To judge sporadic change in the contour shape, generation of deformation or bulge in the contour were compared between the xth shot and the (x+1)th shot under ×50 microscope, and the inlets that exhibited change were counted.

Figure 9:
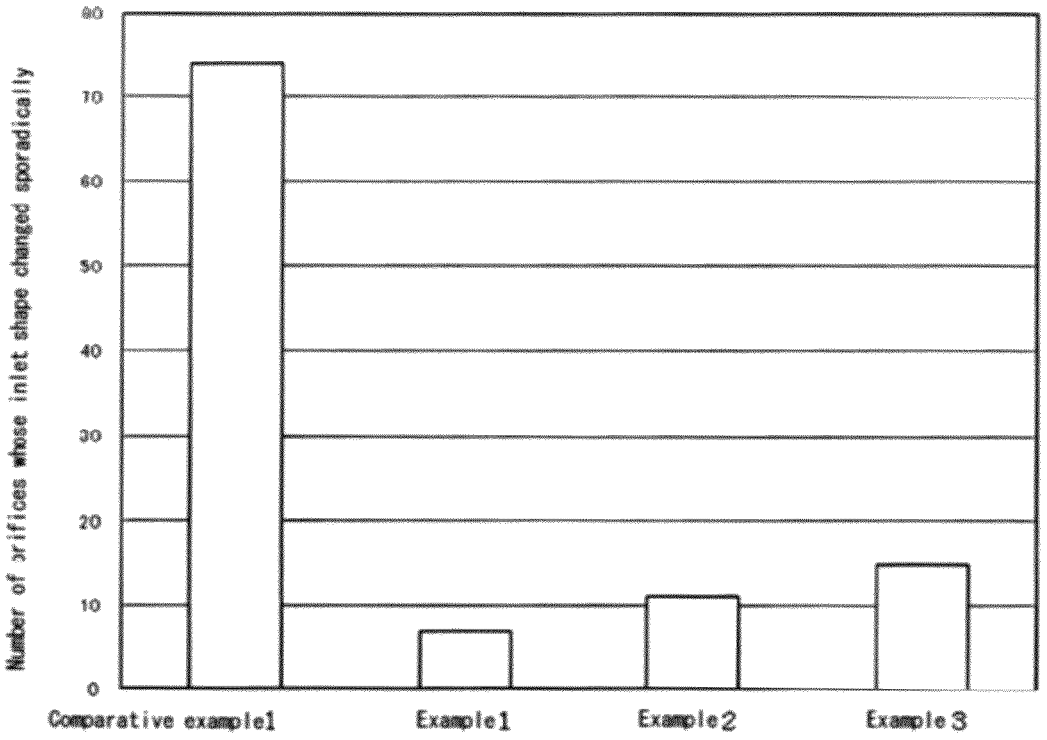
FIG. 9 is a chart showing the number of orifices whose inlet shape changed sporadically at the same orifice positions during 120 continuous punching from the 9,881th to the 10,000th shots in examples 1 to 3 and comparative example 1.
Figure 10:
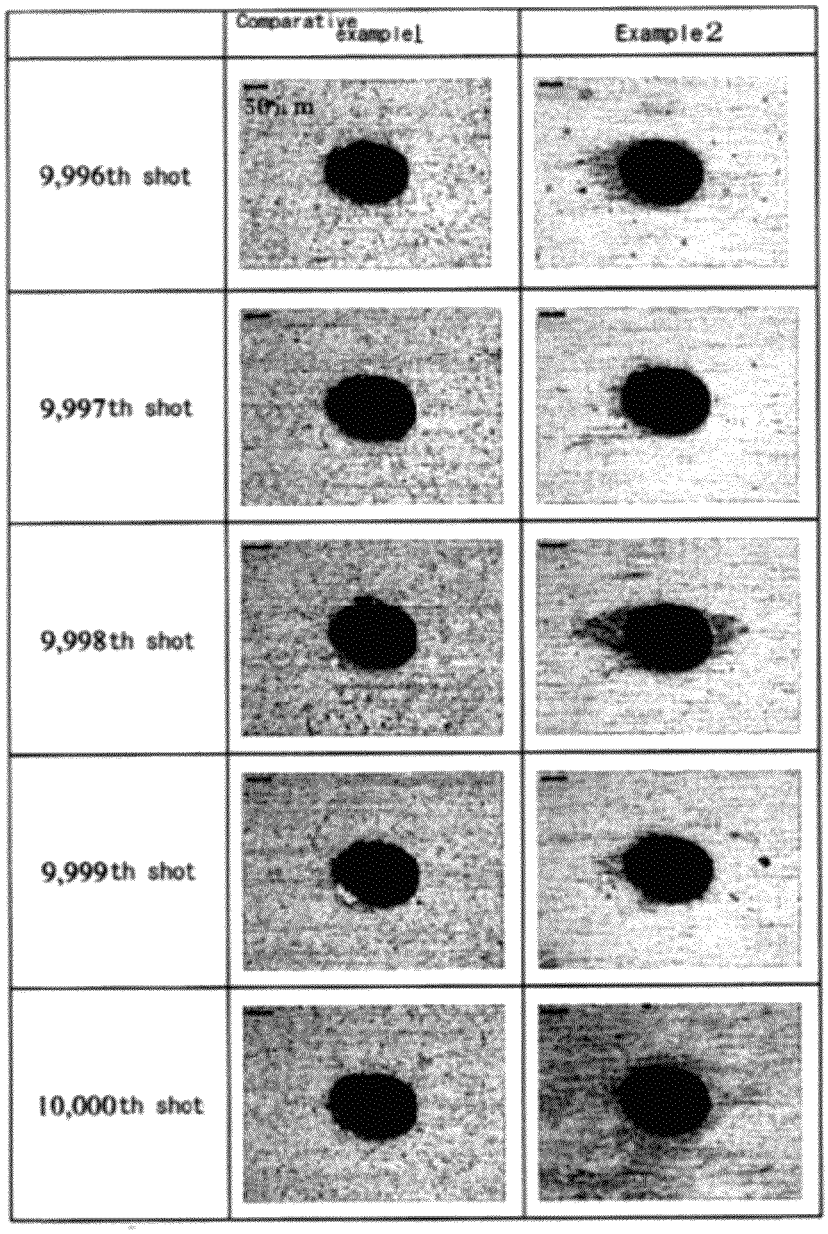
FIG. 10 provides images of the inlet of an orifice at the same position obtained by five continuous punching from the 9,996th to the 10,000th shots in example 2 and comparative example 1.

FIG. 9 exhibits the quantity of orifices whose contour shape had changed sporadically in examples 1 to 3 and comparative example 1. FIG. 10 exhibits the shape of the inlet of the orifice located at the position shown by symbol 2*a* in FIG. 7, of the orifices obtained by continuous five-shot punching from the 9,996th to the 10,000th shots, in example 2 and comparative example 1. In the figure, sporadic change in the outline of orifice inlet was not found with example 2, whereas with comparative example 1, sporadic change in the outline was found.

The results described above are detailed as follows: In comparative example 1, change in the outline of orifice inlet was found in 74 orifices out of 120, whereas with examples 1, 2, and 3, such change was found only in 7, 11, and 15 orifices out of 120 respectively, which is approximately 1/10 to 1/5 of comparative example 1. As described above, the outline of the inlet of the orifices obtained by continuous punching in examples 1 to 3 exhibits excellent stability.

Liquid injection flow rate of each of examples 1 to 3 and comparative example 1 was then measured. Of the orifice plates obtained by conducting 10,000-shot continuous punching, the initial 20, intermediate 20 with the 5,000th shot placed at the center, and the final 20 orifice plates were used. The amount of the total liquid injected from the 12-opening orifice plate shown in FIG. 7 was measured within a given period of time. As liquid injection conditions, a dry solvent was used as the liquid, and measurement was conducted at the pressure of 300 KPa.

Figure 11:
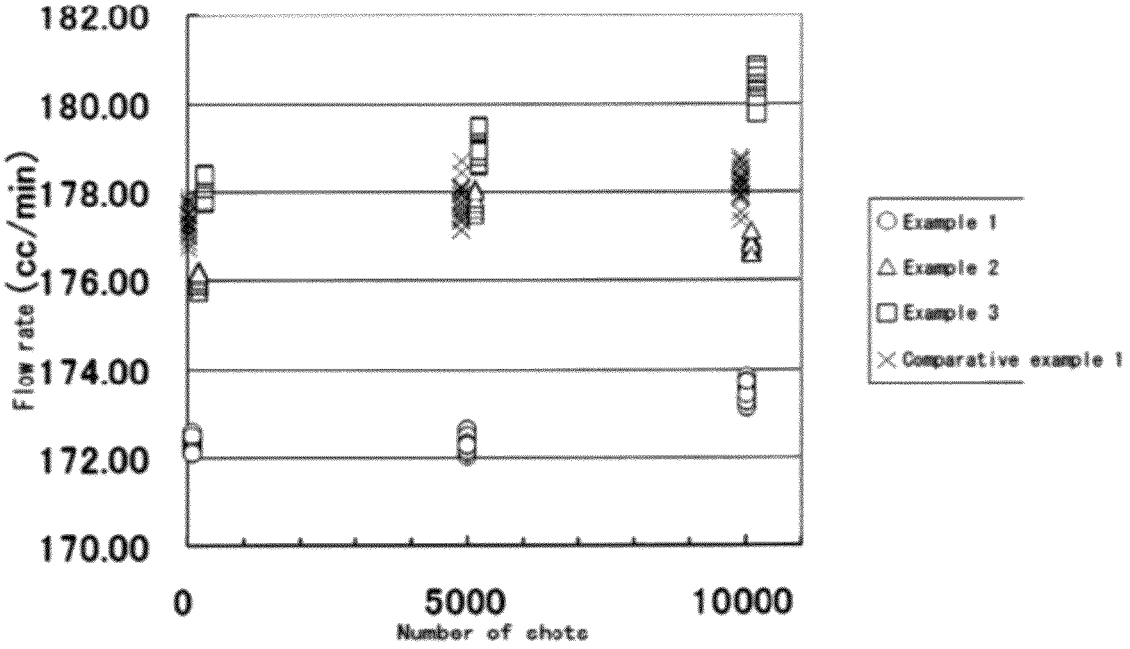
FIG. 11 is a chart showing the fluctuation of flow rate of the liquid injected from each of twenty orifice plates formed in the initial, middle, and last phases of 10,000-shot continuous punching in examples 1 to 3 and comparative example 1.

FIG. 11 exhibits the effect of the shape of the inlet of the orifices formed by conducting 10,000-shot continuous precision slot punching on the fluctuation of injection flow rate of the liquid injected from the orifice plate.

From the data shown in FIG. 11, the difference between the maximum and the minimum flow rate values at the orifices of the orifice plate in examples 1, 2, and 3, and the reduction ratio and the fluctuation (standard deviation) of the difference at each shot were calculated. Calculation results are shown in Tables 3, 4, and 5.

TABLE 3

Difference between the maximum and the minimum values (Unit: cc/min.)

| Number of shots | Com. Ex. 1 | Ex. 1 | Ex. 2 | Ex. 3 |
|---|---|---|---|---|
| 1 | 1.14 | 0.48 | 0.48 | 0.72 |
| 5000 | 1.56 | 0.60 | 0.60 | 0.96 |
| 10000 | 1.44 | 0.72 | 0.54 | 1.08 |

TABLE 4

Reduction ratio of the difference

| Number of shots | Com. Ex. 1 | Ex. 1 | Ex. 2 | Ex. 3 |
|---|---|---|---|---|
| 1 | 100% | 42% | 42% | 63% |
| 5000 | 100% | 38% | 38% | 62% |
| 10000 | 100% | 50% | 37% | 75% |

TABLE 5

| Fluctuation (standard deviation) | | | | |
|---|---|---|---|---|
| Number of shots | Com. Ex. 1 | Ex. 1 | Ex. 2 | Ex. 3 |
| 1 | 0.32 | 0.14 | 0.15 | 0.24 |
| 5000 | 0.41 | 0.18 | 0.18 | 0.35 |
| 10000 | 0.37 | 0.22 | 0.17 | 0.32 |

Under any of the number of shot conditions of the examples, the difference between the maximum and the minimum flow rate values and the fluctuations (standard deviation) obtained using the orifice plate in examples 1, 2, and 3 were found to have decreased. This result confirms that the tolerance of flow rate can be reduced within the range of each example. If a liquid injecting part is equipped with a plurality of these orifices, flow rate fluctuations among the plurality of the orifices are decreased, and consequently, liquids can be injected uniformly from a plurality of orifice plates. For example, when using a product wherein 20 orifice plates in the example are arranged flow rate fluctuations of the liquid injected from each orifice plate are reduced by 50% in example 1, and at least 25% in example 3. From the above, reduction in flow rate tolerance is allowed with this product. By using such orifices, the method of injecting a liquid from a single flow rate adjusting mechanism through a plurality of injecting bodies with reduced fluctuation is allowed, unlike the conventional method in which each injection part is equipped with an adjusting mechanism to control injection flow rate.

What is claimed is:

1. A method of manufacturing an orifice plate for fluid injection, comprising:

subjecting austenitic stainless steel containing Ni and Cr to cold rolling and reverse transformation heat treatment to have an average crystal grain size of 3 μm or less to make a plate-shaped stainless steel having a thickness of 1.2 mm or less; and forming an orifice on the plate-shaped stainless steel by performing shear punching with a punch and a die, wherein the reverse transformation heat treatment is conducted so that the amount of stress-induced martensite generated by the cold rolling decreases to 5% or lower when measured using a ferrite content measuring instrument.

2. The method of manufacturing an orifice plate for fluid injection as set forth in claim 1, wherein the cold rolling and the reverse transformation heat treatment are conducted repeatedly so that the average crystal grain size of the plate-shaped stainless steel becomes 3 μm or less.

3. The method of manufacturing an orifice plate for fluid injection as set forth in claim 1, wherein the cold rolling of 50% to 60% rolling reduction is conducted and the reverse transformation heat treatment is conducted so that the amount of stress-induced martensite generated during the cold rolling decreases to 5% or lower.

4. The method of manufacturing an orifice plate for fluid injection as set forth in claim 1, wherein the orifice is formed using the punch and the die, with working angle maintained between 0° to 50°.

5. The method of manufacturing an orifice plate for fluid injection as set forth in claim 2, wherein the cold rolling of 50% to 60% rolling reduction is conducted and the reverse transformation heat treatment is conducted so that the amount of stress-induced martensite generated during the cold rolling decreases to 5% or lower.

6. The method of manufacturing an orifice plate for fluid injection as set forth in claim 2, wherein the orifice is formed using the punch and the die, with working angle maintained between 0° to 50°.

7. The method of manufacturing an orifice plate for fluid injection as set forth in claim 3, wherein the orifice is formed using the punch and the die, with working angle maintained between 0° to 50°.

8. A method of manufacturing an orifice plate for fluid injection, comprising:

preparing austenitic stainless steel containing Ni and Cr, subjecting the austenitic stainless steel to cold rolling and reverse transformation heat treatment to make a plate-shaped stainless steel having an average crystal grain of 3 μm or less; and forming orifices on the plate-shaped stainless steel by performing shear continuous multi-shot punching with a punch and a die, whereby each of the orifices has a uniformity of contour lines of an inlet and flow rate fluctuations decreases, wherein the cold rolling and the reverse transformation heat treatment are conducted repeatedly so that the average crystal grain size of the plate-shaped stainless steel becomes 3 μm or less.

9. The method of manufacturing an orifice plate for fluid injection as set forth in claim 8, wherein the orifice is formed using the punch and the die, with working angle maintained between 0° to 50°.

10. A method of manufacturing an orifice plate for fluid injection, comprising:

preparing austenitic stainless steel containing Ni and Cr, subjecting the austenitic stainless steel to cold rolling and reverse transformation heat treatment to make a plate-shaped stainless steel having an average crystal grain of 3 μm or less; and forming orifices on the plate-shaped stainless steel by performing shear continuous multi-shot punching with a punch and a die, whereby each of the orifices has a uniformity of contour lines of an inlet and flow rate fluctuations decreases, wherein the cold rolling of 50% to 60% rolling reduction is conducted and the reverse transformation heat treatment is conducted so that the amount of stress-induced martensite generated during the cold rolling decreases to 5% or lower.

11. The method of manufacturing an orifice plate for fluid injection as set forth in claim 10, wherein the orifice is formed using the punch and the die, with working angle maintained between 0° to 50°.

* * * * *